US006205919B1

(12) United States Patent
Simeth

(10) Patent No.: US 6,205,919 B1
(45) Date of Patent: Mar. 27, 2001

(54) MULTICOLOR SHEET-FED PRINTING PRESS

(75) Inventor: Claus Simeth, Geisenheim (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/230,117

(22) PCT Filed: Jul. 23, 1997

(86) PCT No.: PCT/EP97/03979

§ 371 Date: Sep. 3, 1999

§ 102(e) Date: Sep. 3, 1999

(87) PCT Pub. No.: WO98/03336

PCT Pub. Date: Jan. 29, 1998

(30) Foreign Application Priority Data

Jul. 24, 1996 (DE) ..... 196 29 822

(51) Int. Cl.[7] ..... B41F 5/16
(52) U.S. Cl. ..... 101/183; 101/230
(58) Field of Search ..... 101/136, 137, 101/174, 175, 181, 183, 229, 230, 389.1

(56) References Cited

U.S. PATENT DOCUMENTS

| | | | | |
|---|---|---|---|---|
| 2,911,907 | | 11/1959 | Davidson . | |
| 3,347,160 | | 10/1967 | Rozee . | |
| 3,384,011 | | 5/1968 | Bolza-Schünemann . | |
| 3,949,670 | | 4/1976 | Katsuji . | |
| 4,621,576 | * | 11/1986 | Wirz | 101/230 |
| 5,410,965 | * | 5/1995 | DeVries | 101/389.1 |
| 5,469,787 | * | 11/1995 | Turner et al. | 101/211 |

FOREIGN PATENT DOCUMENTS

| | | |
|---|---|---|
| 24 35 203 C2 | 10/1981 | (DE) . |
| 34 19762 A1 | 11/1985 | (DE) . |
| 43 03 797 A1 | 8/1994 | (DE) . |
| WO 95/25015 | 9/1995 | (WO) . |

* cited by examiner

*Primary Examiner*—Ren Yan
(74) *Attorney, Agent, or Firm*—Leydig, Voit & Mayer, Ltd.

(57) ABSTRACT

Multicolor prints should be economically producible in a printing machine suited for automation. For this purpose a printing machine is configured which operates according to the collecting (collect-run) principle. The multicolor prints are collected either on a rubber cylinder (21) or on a printing cylinder (5). The printing machine is capable of processing two printing colors in a printing unit (11, 12). For the execution of the collecting printing, the sheets are fed in a cycle offset to the rotation of the collecting cylinder. For the printing of both sides double-sized sheet-conducting drums (6, 13, 14) are provided, or cylinders with a turning device or alternately set-on printing units.

15 Claims, 6 Drawing Sheets

MULTICOLOR SHEET-FED PRINTING PRESS

FIELD OF THE INVENTION

The invention relates to a sheet-fed rotary printing machine for multicolor printing.

BACKGROUND OF THE INVENTION

For the printing of small-format printing sheets it is a known practice to use printing units in which the cylinders participating in the printing, such as a plate cylinder, a rubber cylinder and a printing cylinder, have different diameters. Thereby mechanical expenditure can be saved in the field of the printing plates, of the rubber blankets or of the printing cylinder.

From DE-PS 24 35 203 a sheet-fed rotary printing machine is known. It has, in the most diverse configurations, plate cylinders with simple or single diameter, a rubber cylinder with multiple diameter, and a printing cylinder with single diameter. Thereby from differently installable printing units from a particular plate cylinder, a partial image of a print image can be printed on one of several segments of the rubber cylinder. Simultaneously, this print image can be printed on a printing sheet guided on the printing cylinder, in which process the printing sheet with the printing cylinder revolves in correspondence to the movement of the segments of the rubber cylinder and is printed from this latter.

In U.S. Pat. No. 3,347,160 there is described an ink roller device for a multicolor rotary offset printing machine. This printing machine has a plate cylinder and rubber cylinder in each case with multiple diameter on which there is allocated a printing cylinder with single diameter. In the printing the printing plate consisting of several image parts is generated on the plate cylinder of several cycled inking and moistening mechanisms, transferred to the multiply large rubber cylinder and printed on a printing sheet guided on the printing cylinder. There the printing cylinder rotates a number of times corresponding to the diameter ratio between rubber cylinder and printing cylinder until all the print image parts are transferred to the printing sheet. This multiple color printing machine is suited for the so-called proof printing. The disadvantage in these devices is that they can be produced, to be sure, as single print units, but that the expenditure for the printing of images that contain more color than the particular printing machine permits is very high. These printing machines, accordingly, are suited only for special printing processes.

OBJECTS AND SUMMARY OF THE INVENTION

An object of the invention is to produce a machine configuration which, with the simplest manner of construction, has arbitrarily combinable printing units for generating printing sheets with differing number of colors, which does not require any exchanging of aggregates or assemblies, and is suited for a high throughput with arbitrary edition levels, in which printing sheets are to be producible in both-sided printing.

Anther object of the invention is to improve a device of the foregoing type 50 that from standard elements a simple and therewith cheap printing machine results, which by the combination of components of this type with one another permits differently configurable multicolor prints, without the printing machine having to be refitted or having too low a performance, in which printing sheets printed on both sides are to be producible.

The present invention provides these and other advantages and overcomes the drawbacks of the prior art by providing a sheet-fed printing machine for printing a print image on sheets in one or more colors on both sides of the sheet in which the sheet-conducting drums or cylinder are provided in each case with a working surface. Thereby there is yielded a slender sheet running and in all decisive positions sufficient space for the complete printing-out and an unhampered sheet turning. The resulting throughput reduction is balanced by the simplification of the machine concept.

Fundamentally all the plate cylinders are provided with two printing plates. Here it is especially advantageous that, on the basis of standard printing machines, simplified forms of execution of printing machines are produced which, with little expenditure permit economical printing processes, in which heed is given to a so-called slender sheet run, and with costs for the building of the machine that are reduced because of the simple elements.

For one, this can occur through the use of a printing cylinder provided with simple or single diameter, which rotates a number of times only for the reception of print images, while the other cylinders or drums, all equally large and provided with doubled diameter, rotate only at half the turning speed of the printing cylinder.

In a further form of execution the rubber cylinder is constructed as a cylinder provided with single diameter. In the proposed standard printing process proposed to that end it collects print images of different colors given on the plate cylinder and prints them in a single printing operation onto the printing sheets held on the printing cylinder.

These and other features and advantages of the invention will be more readily apparent upon reading the following description of preferred exemplary embodiments of the invention and upon reference to the drawings wherein:

DETAILED DESCRIPTION OF THE PREFERRED EMBODIMENT

Figure 1:
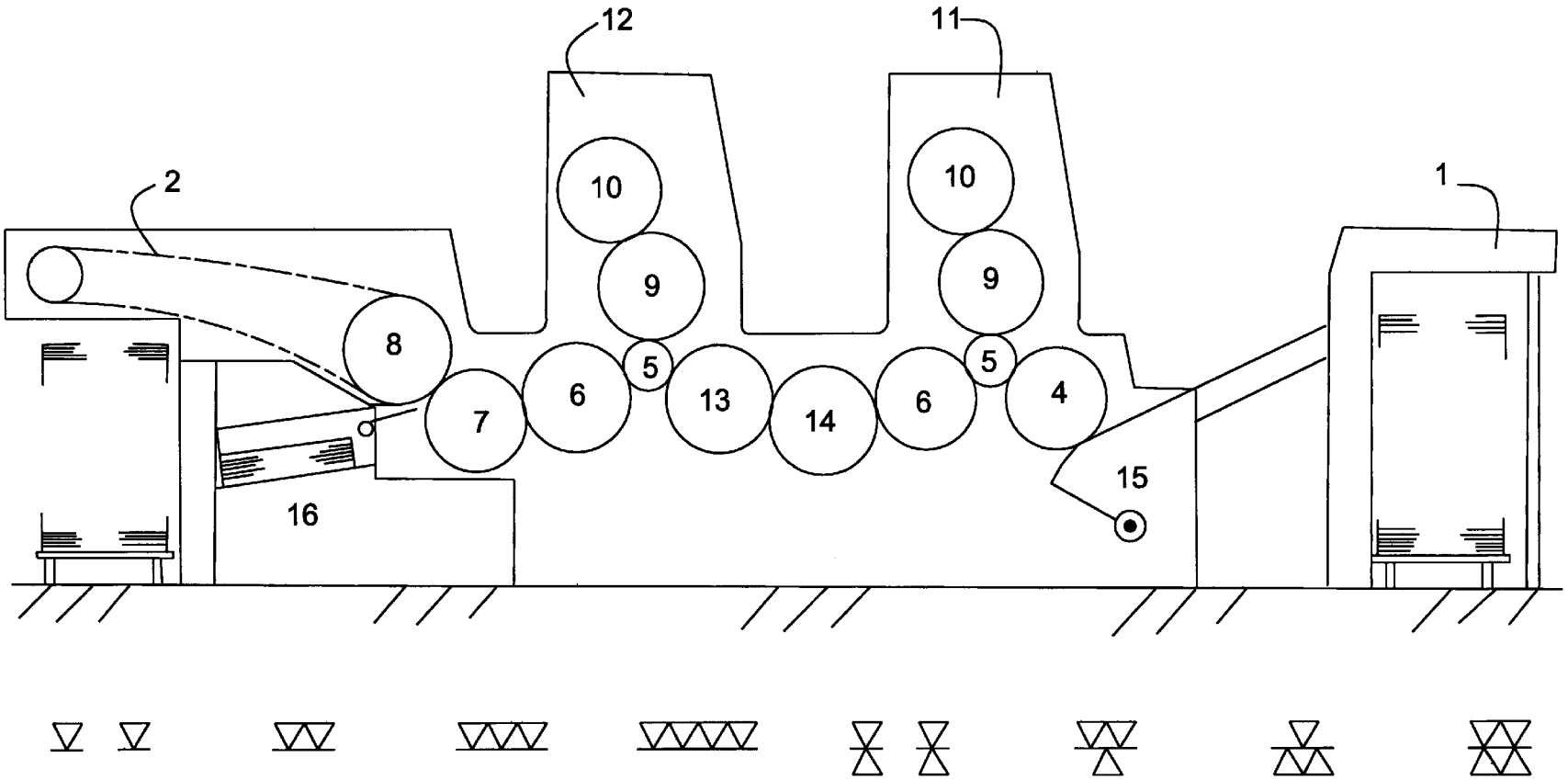
FIG. 1 is a schematic side elevation view of a four-color sheet printing machine with a printing cylinder with simple or single diameter.

In FIG. 1 there is represented a sheet printing machine which contains a feeder unit 1, a discharge or delivery 2, and printing mechanisms 11 and 12. The printing sheets are fed from the feeder unit 1 to the printing mechanism 3 and laid out in the discharge unit 2. For the sheet transport there is provided a feed drum 4 which transfers the printing sheets to a first printing cylinder 5. From there the printing sheets are led over a first sheet guide drum 6, and further sheet guide drums 13 and 14, to a second printing cylinder 5, from where the printing sheets are transported to further sheet guide drums 6 and 7, to a discharge drum 8 and then deposited in the discharge unit 2.

The printing units are constructed in principle alike. From the printing cylinder 5 the sheet is given over in each case to a sheet guide drum 6. Further, feed drum 4 and sheet guide drum 13 correspond to one another.

The feed drum 4, the sheet guide drums 6 and 7 and the discharge drum 8 have a so-called doubled diameter. The printing cylinder 5 has one with simple or single diameter.

The diameter ratio relates to the length of a maximally-to-be processed printing sheet. In the printing mechanism 3 there are arranged, further, a rubber cylinder 9 and a plate cylinder 10, which both have in each case a doubled diameter. The sheet-guiding cylinders or drums, insofar as they are provided with doubled diameter, can be equipped with one or two gripper rows for the transport of printing sheets, in which system, however, for the complete printing process on one printing sheet, only one gripper row or working surface is used.

Before the printing of a printing sheet, this sheet is fed for example from a pre-gripper 15 to the feed drum 4 and there given over to the printing cylinder 5. The print images that were generated on a plate cylinder 10 with doubled diameter and two working surfaces are transferred to a rubber cylinder 9 likewise with doubled diameter and two working surfaces and printed on the printing sheet held there as a two-color print, during two revolutions of the printing cylinder 5.

When print images are mentioned, as a rule in the case of several print images there are meant the differently colored partial images of a multicolor print. Only for monochrome printing is this not the case.

With a printing machine of this construction form, a multicolor printing machine is simply combinable from the basic components plate cylinder 10, rubber cylinder 9, printing cylinder 5, sheet guide drum 6 and sheet guide drum 13 or 4. The connection between the printing mechanisms 11, 12 is made by means of the sheet guide drum 14 which corresponds to the sheet guide drum 7, which also leads to the discharge unit 2. The printing machine is built up from identical printing mechanisms and is very compact in the zone of the printing cylinder 5. Further, through the arrangements of two workings surfaces on plate cylinder 10 and rubber cylinder 9 with doubled diameter, their handling is improved.

The printing machine in FIG. 1 makes it possible to print with doubled throughput if in both printing mechanisms 11 and 12, in each case two print images are provided on the plate cylinder, which are of the same color. Further, it is possible to work in two colors with half throughput, if in each printing mechanism 11 and 12 on the respective plate cylinder 10 there is provided in each case only one print image, which then have a different color. There further production possibilities are yielded from three-color to four-color printing. These production types run in the half sheet throughput mode.

Finally also for small editions a double edition can be driven, as on each printing plate of the plate cylinder 10 another monochrome image is generated and per printing sheet in each case in alternation the one and the other print image are printed. The different printing sheets can be deposited on separate stacks, for example with the aid of the auxiliary discharge unit 16 and of the discharge unit 2. For this a control for the drum or cylinder allocated to the auxiliary discharge unit 16 is required, which (control) provides that every other printing sheet is sluiced out.

Furthermore, the sheet guide drums 6, 13, 14 can also be provided as a so-called turning arrangement. They then have devices by means of which a printing sheet is taken from the middle sheet guide drum 14 on its rear edge and is fed in inverted position and reversed transport direction to the next printing mechanism. The printing sheet is printed there from its reverse side. In this manner the printing machine is then in a position to print in one color on two sides, on one side in two colors, on the other in one color, and on two sides in two colors. These principles are known. Through the arrangement of the turning arrangement with sheet guide drums with doubled diameter and only one gripper row, the turning process is much less complicated than in known devices of this type, as will be explained later.

The printing machine is expandable, furthermore, to arbitrarily many further printing mechanisms.

The printing machine according to FIG. 1 further has, as special feature, an auxiliary discharge unit 16. At that location, as needed, a proof sheet can be laid out, or this position can be used as waste discharger. The auxiliary discharge unit 16 is served by delivery of a printing sheet from the laying-out drum 8 by means of a flexible control arrangement in engagement with the grippers of the discharge drum 8.

Figure 2:
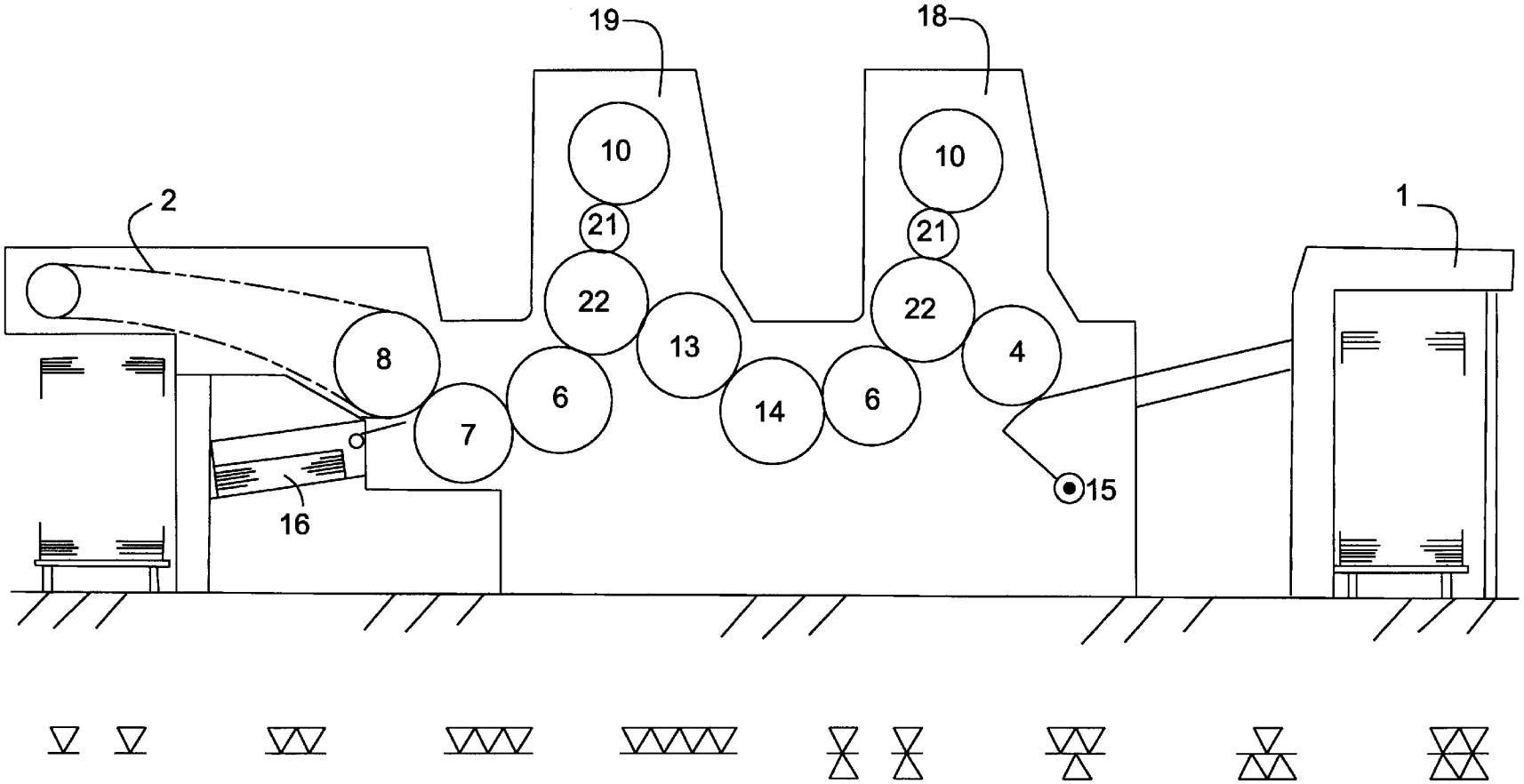
FIG. 2 is a schematic side elevation view of a four-color printing machine with a rubber cylinder with single diameter.

A further machine configuration is shown in FIG. 2. Between feeder unit 1 and discharge unit 2 there are arranged printing mechanisms 17 and 18, which, as already known, have a feed drum 4, a plate cylinder 10, a sheet guide drum 6, a sheet guide drum 7, and a discharge drum 8. Further, for the connection of the printing mechanisms 17 and 18 there are provided sheet guide drums 13 and 14. Here, too, the auxiliary discharge unit 16 is provided and the feed drum 4 operates together with a pre-gripper system 15. Finally, there are provided a first 21, and a second printing cylinder 22 which has a doubled diameter. There they can have one or two working surfaces, only one, however, being used. It cooperates with a rubber cylinder 21 which has only a single diameter.

This printing machine operates, unless meant for monochrome printing, according to the so-called rubber collecting print process. This means that in the rotation of the rubber cylinder 21 two partial images of a print image provided on the plate cylinder 10 overlay one another and are printed in common in a printing zone on printing sheets held on the printing cylinder 22 Therewith in the printing mechanism 18 and 19 in each case a two-color print can be generated, in which the two print images can complete one another, so that altogether a four-color print results. This four-color print is generated in each case with altogether two revolutions of the rubber cylinder 21 of the two printing mechanisms.

Also in a printing machine of this construction various printing processes are conceivable comparable with the printing machine according to FIG. 1. For one, in each rotation of the rubber cylinder 21 a monochrome image can be printed on printing sheets that are held on the printing cylinder 22. There on the printing cylinder 22 there must be provided a series of two working surfaces and two gripper rows, which are loaded individually with a printing sheet on each revolution. On the printing cylinder 10 then there must be provided two like print images for a single printing color.

Finally, as described earlier, it is also possible to provide two partial images of different colors of a single print image. There, on rotation of rubber cylinder 21, first the one print image is transferred to the rubber blanket, and then the second print image is superposed onto this. The print images now superposed on one another are then printed in common in the printing zone between the rubber cylinder 21 and the printing cylinder in common onto the printing sheet supported there. Thus, on each rotation of the rubber cylinder 21 a two-color print can be generated, in which operation the printing machine is driven with half throughput; i.e. on loading of every other gripper row on the feed drum 4 or printing cylinder 22, it is driven with one printing sheet. This, obviously, holds only if on each sheet-conducting cylinder the machine is not occupied with only one working surface and gripper row.

Further, on the plate cylinders 10 there can be provided in each case a monochrome image. Then this printing machine would print in two colors and only on every other rotation of the rubber cylinder would generate a printing sheet, i.e. per revolution of a printing cylinder 22 one printing sheet printed in two colors.

Finally it can also be provided to print on each plate cylinder 10 in one color with two print images, so that on each revolution of the rubber cylinder 21 there can also be transferred a print image onto the printing cylinder 22. Then again the work is done with full throughput on the printing cylinder with two printing sheets per revolution, which, however, are then printed with one color in the first printing mechanism and with a second color in the second printing mechanism.

This printing machine, too, is provided with an auxiliary discharge unit 16.

Also in this machine it is possible to install a turning arrangement and therewith to create the possibility for two-sided printing in various configurations as described above.

The configurations described can be varied to the effect that in a printing mechanism instead of a doubled plate cylinder there can also be allocated to a rubber cylinder two plate cylinders. Furthermore, it is possible to allocate to a printing cylinder with multiple diameter two printing mechanisms with rubber cylinder and plate cylinder with single diameter. Finally in the latter configuration, to the rubber cylinders with single diameter there can also be allocated plate cylinders with doubled diameter. The principle of the lead-through of only one printing sheet on sheet-guiding cylinders with single or doubled diameter and only single occupation, however, is not to be abandoned.

Figure 3:
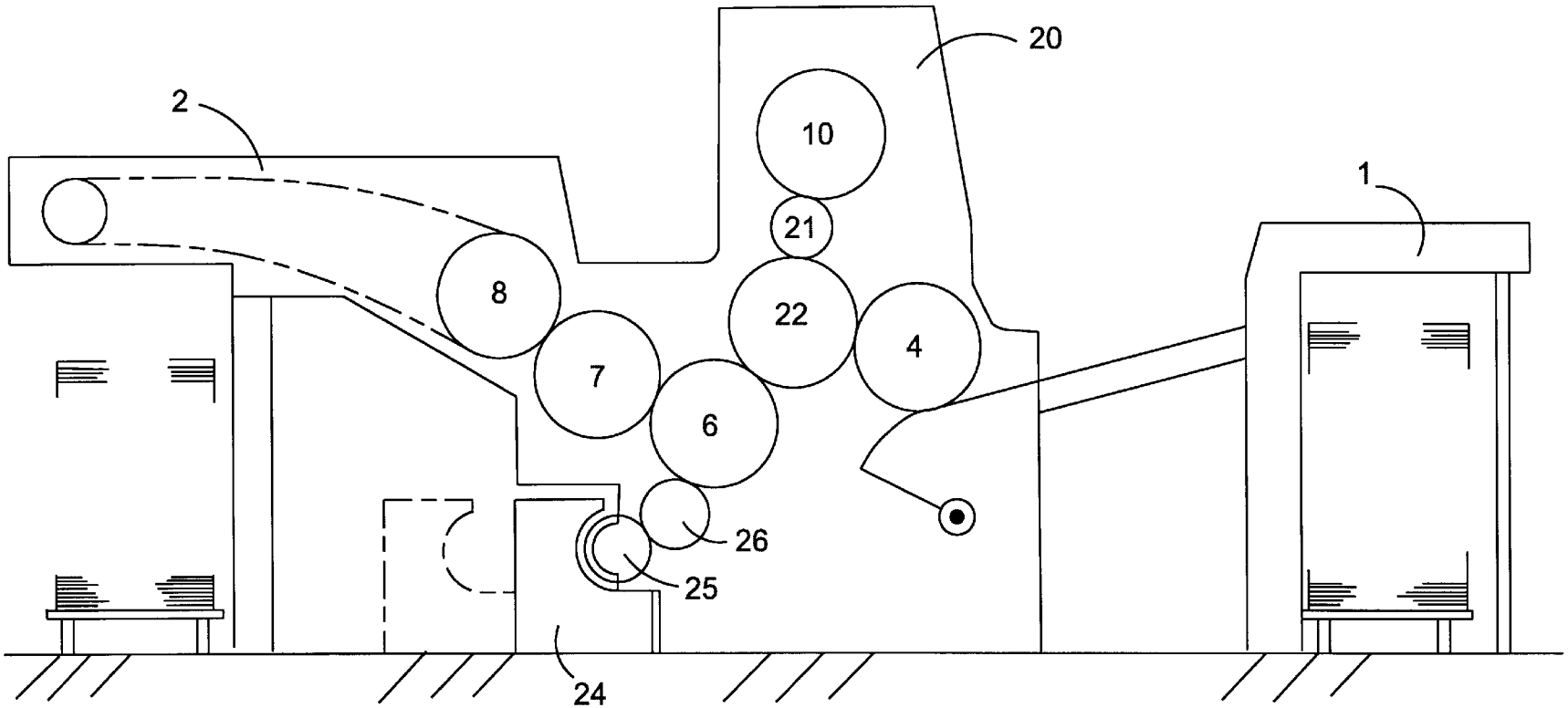
FIG. 3 is a schematic side elevation view of a three-color printing machine with rubber cylinders with single diameter and a perfecting printing mechanism.
Figure 4:
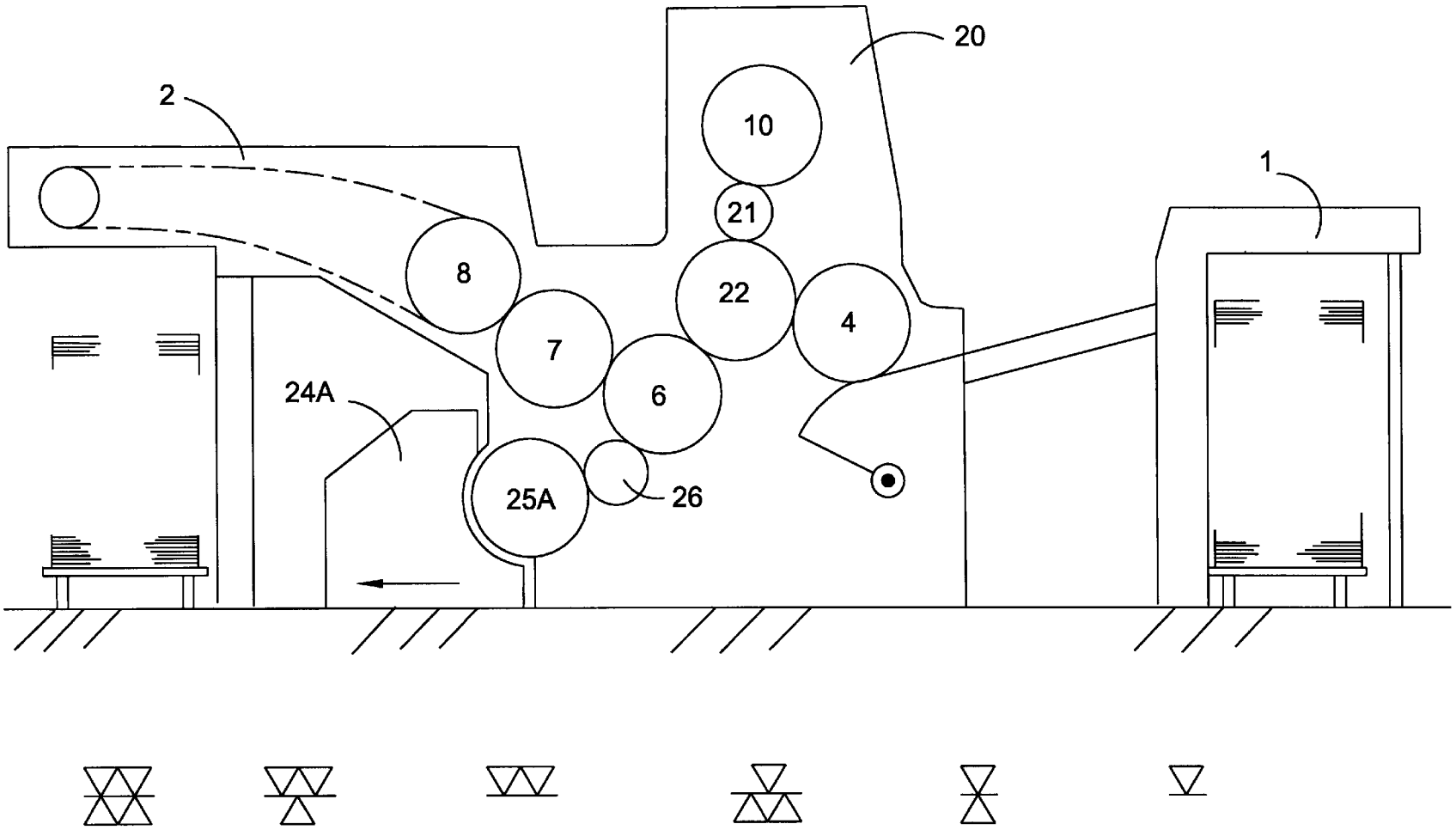
FIG. 4 is a schematic side elevation view of a four-color printing machine with rubber cylinders with single diameter and a perfecting printing mechanism.

Finally, in FIGS. 3 and 4 there is represented a further configuration of the printing machine according to the printing principle of the printing machine in FIG. 2. They too have, between feeder unit 1 and discharge unit 2, a printing mechanism 20 in which there are provided a plate cylinder 10 a printing cylinder 22, a feed drum 4, and a sheet guide drum 6. Between plate cylinder 10 and printing cylinder 22 there is provided a rubber cylinder 21 having a single diameter. The fundamental configuration corresponds to that in FIG. 3, so that also the functioning of this printing mechanism is like that in FIG. 3. Therewith, therefore, monochrome or two-color prints can be generated in different throughputs. Further, to the sheet guide drum 6 there is allocated a further printing mechanism. This printing mechanism consists of an inking mechanism 24 which is arranged slidably, a plate cylinder 25 and a rubber cylinder 26. The plate cylinder 25 and the rubber cylinder 26 are provided only with single diameter and therefore are recognizably suited only for the applying of a single print image color. What is essential is the arrangement of the rubber cylinder 26 on the underside of the sheet guide drum 6, which here takes over the function of a printing cylinder. Since the printing sheet, after it was printed on the upper side between rubber cylinder 21 and printing cylinder 22, now with its printed side in contact with the sheet guide drum 6, its reverse side lies opposite the rubber cylinder 26 and can be printed from there. Therewith in this printing machine it is possible to complete a two-color print on the one side with a further print image on the other side of the printing sheet. Furthermore, there can also be generated a monochrome printing on both sides.

In FIG. 4 there is represented a configuration similar to that in FIG. 3. Here, to be sure, as perfecting printing mechanism a plate cylinder 25A with doubled diameter is combined with a rubber cylinder 26 with simple diameter, so that here also the perfecting printing proceeds according to the rubber collecting principle. The printing machine is capable, therefore, of operating on both sides in one color in full throughput, therefore as well as in 2/1-color with half throughput, and also in 2/2-color with half throughput. To the plate cylinder 25A for this purpose there is allocated an inking mechanism 24A removable in a known manner. This inking mechanism 24A contains two inking arrangements and possibly also two moistening arrangements that are cyclically switchable in order to make it possible to apply one or two colors to the plate cylinder 25A. In the machines according to FIGS. 3 and 4 no sheet turning is required.

Figure 5A:
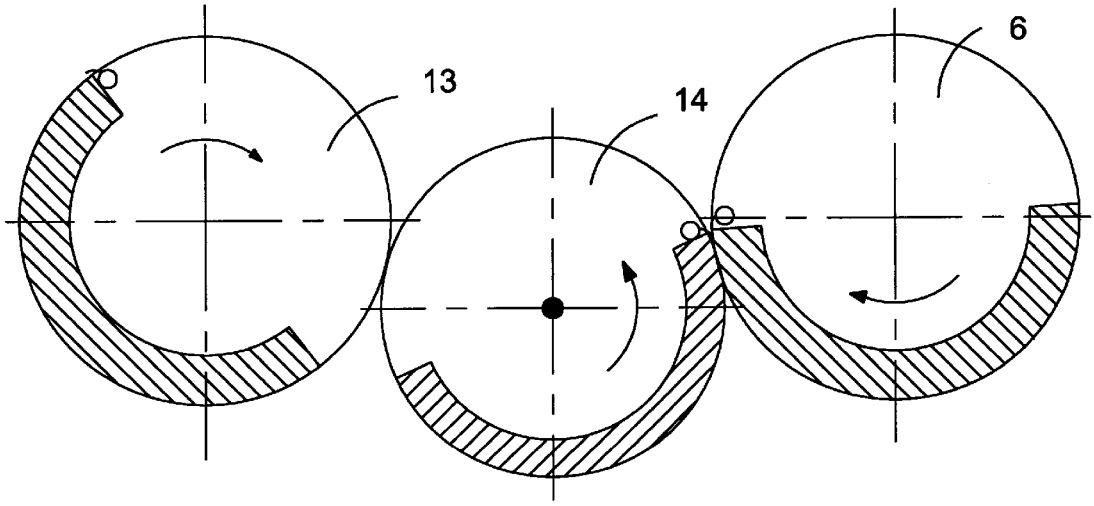
FIGS. 5*a* and 5*b* are a schematic side elevation view of a turning mechanism and FIG. 6 is a schematic side elevation view of a printing machine with two double printing mechanisms.
Figure 5B:
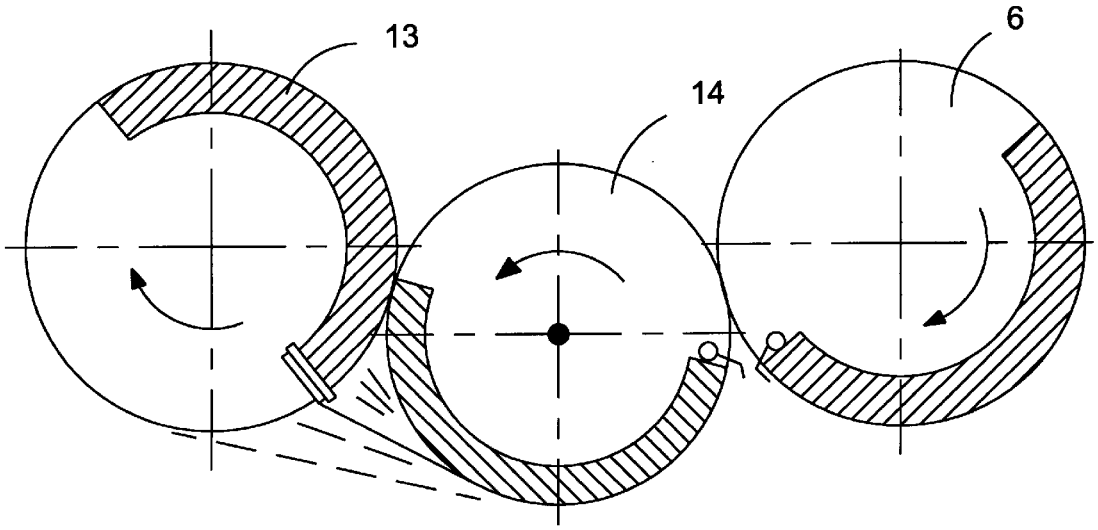

The advantage of a turning mechanism in the printing machines described in FIGS. 1 and 2 is shown in FIG. 5*a* and 5*b*. In FIG. 5*a* the sheet-guiding drums 6, 13 and 14 are shown in the normal allocation for printing on one side. The printing sheet is transferred to the sheet guide drum 6 from a printing cylinder, and transferred again over the sheet guide drums 13, 14 to a further printing mechanism.

In FIG. 5*b* there is represented the allocation for the perfecting print operation. By a separating of the drives between the sheet guide drums 13 and 14 the machine zones lying to the right and to the left of the separation point are shifted with respect to one another. There gripper rows 34 of the sheet guide drum 13 are set on the particular determinative end of the printing sheet on the sheet guide drum 14. The gripper rows 34 are equipped with so-called turning grippers. These may comprise, for example, suction arrangements in order to take the printing sheet with its end from the sheet guide drum 14. It is also possible to form the surface of the sheet guide drum 14 in such manner that the gripper rows 34 can directly grip the end of the printing sheet. The gripper rows 34 can then be constructed as double systems or also as so-called tong-grippers.

In the transport of the printing sheets in the setting for the perfecting printing, accordingly, the sheet end is grasped, while the sheet beginning is freed not in the contact zones of the sheet guide drums 13, 14 but only after grasping of the sheet end by the gripper rows 34. The printing sheet is then led onward, as indicated, with the sheet end forward and downward from the sheet guide drum 13. Through the simple occupation of the sheet guide drums 13 and 14 there is given a great deal of play space for the allocation of the drums to one another. The rotary position makes it possible, for example, to arrange the sheet guide drum 14 also directly between the adjacent drums, without its being possible for difficulties to arise in the sheet transport. The sheet running is slender and well controllable.

Figure 6:
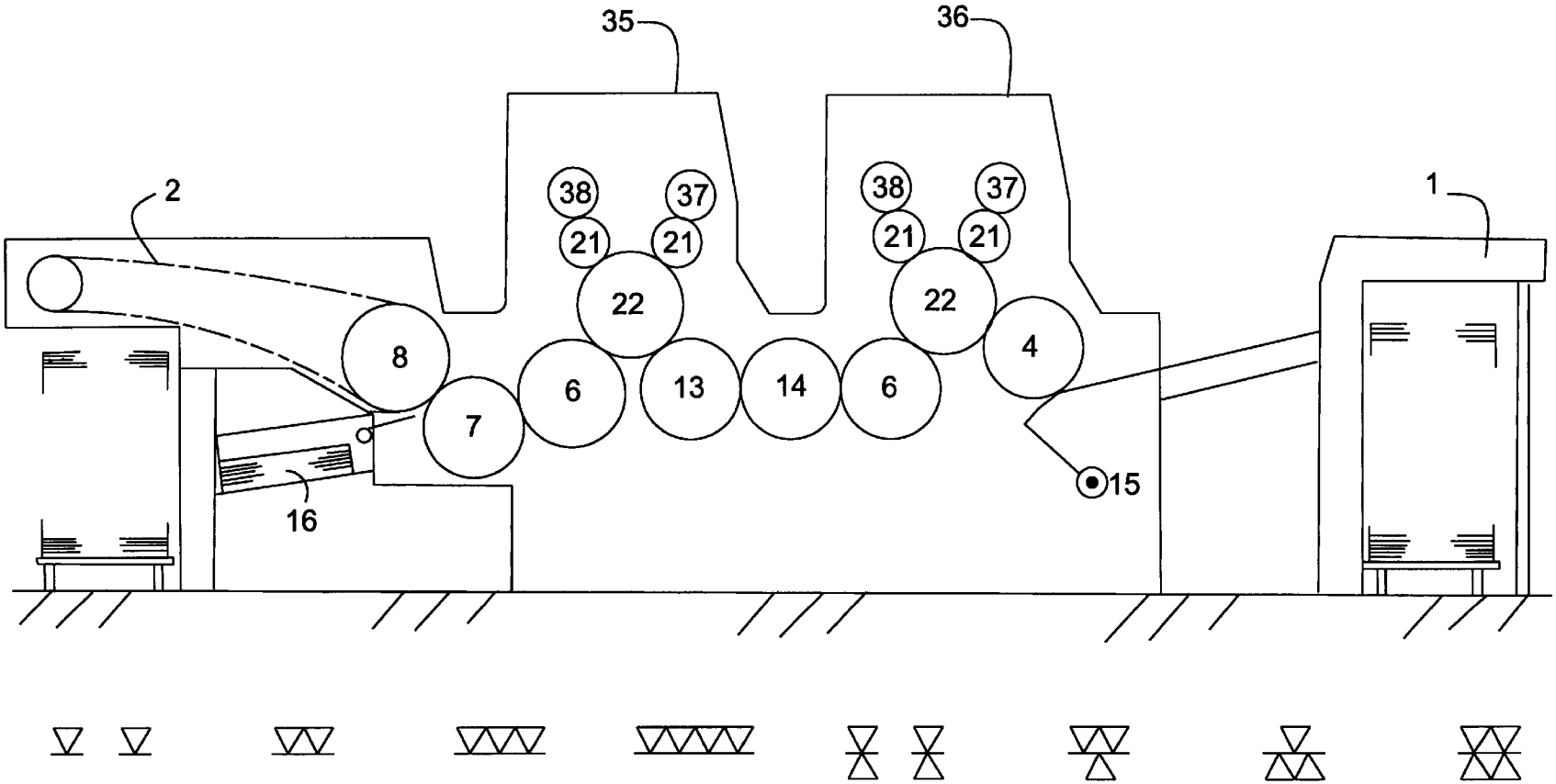

In FIG. 6 there is shown a four-color printing machine with two double printing mechanisms 35, 36. The printing mechanisms 35, 36 have as special feature the allocation of plate cylinders 37, 38 with single diameter. Therewith on each printing cylinder 22 likewise two print images can be printed in common. Each rubber cylinder 21, to be sure, transfers only one print image. The printing sheets are guided over the sheet guide drums 6, 13, 14 and can be turned there in a turning arrangement for the two-sided printing.

The printing mechanisms 35, 36 allocated to the printing cylinders 22 consist in the example represented, therefore of plate cylinders 37, 38 with single diameter, and of rubber cylinders 21 with single diameter. The printing occurs then in one throughput on the printing cylinder 22, in which the printing zones lie so far apart that the first print is concluded before the second one begins. The printing cylinder 22 has either one working surface and one gripper row or two working surfaces and two gripper rows, one gripper row being selectable for the printing.

This configuration can be varied as already described under FIG. 3, as in each case plates with doubled diameter are assigned to the rubber cylinders 21. Then a four-color print can be generated per printing passage, in which again two print images per rubber cylinder 21 are collected. The machine shown is then suited for eight-color printing.

It is important for the execution of the production types described that the control of the inking mechanisms or of the inking-and-moistening mechanisms on the plate cylinders be made flexible; this, however, is known from the state of the art. According to this, each inking mechanism is to be emplaceable and removable or switchable on and off for each plate cylinder revolution. For this, in the case of a plate cylinder with doubled diameter and two successively lying images, there must be provided an arrangement of two successively lying inking mechanisms which are individually driven and thus can ink the print images differently. Further, both print images should be continuously inked and moistened with a single color. For this only one inking or inking-and-moistening mechanism is continuously engaged.

Further in the application of two printing inks, if needed, the work should be done only with one moistening mechanism. For this, one moistening mechanism is shut off and the other one continuously engaged. Moreover, the printing machine can also be provided with only one single moistening mechanism per printing mechanism.

With these arrangements and construction means known for the control of the inking and moistening mechanisms it is possible to operate all the indicated printing machines in the different types of production described.

The printing machines are conceived in the simplest form of execution and are especially suited for taking automation measures on the plate cylinder 10. Here the large diameter of the plate cylinder 10 is effective. It is thus easily possible to mount both several picturing arrangements, as well as feed arrangements of pictured printing forms. Likewise it is easily possible to mount feed arrangements for printing form raw material inside the plate cylinder 10. The printing plates can be divided and also combined. This is dependent exclusively on the production expenditure. The arrangements mentioned are not described in detail here, since they are known and were not an aim of the invention.

What is claimed is:

1. A sheet-fed printing machine for printing a print image on sheets in a plurality of colors on first and second sides of the sheet utilizing an indirect printing process, the printing machine comprising, in combination:

a sheet-feeding unit, a plurality of printing mechanisms each of which comprises a plate cylinder having a plurality of printing plates mounted thereon for transferring at least two differently colored partial images of a full multicolor print image, a plurality of inking mechanisms which can be cyclically brought into operative engagement with the plate cylinder, and a rubber cylinder and a printing cylinder which together define a printing zone, and a plurality of sheet-guiding cylinders each of which is configured to transport only a single sheet at a time, said sheet-guiding cylinders including a plurality of sheet-turning cylinders which are arranged between the printing mechanisms, the sheet turning cylinders having a diameter corresponding to twice the full multicolor print image length and being operable to turn a sheet between the first and second sides.

2. The printing machine according to claim 1 wherein each printing cylinder has a basic diameter and each rubber cylinder has a diameter equal to twice the basic diameter.

3. The printing machine according to claim 1 wherein the rubber cylinder has a diameter corresponding to twice the print image length and the printing cylinder has a diameter corresponding to an odd-multiple of the print image length.

4. A sheet-fed printing machine for printing a print image on sheets in a plurality of colors on opposing first and second sides of the sheet utilizing an indirect printing process, the printing machine comprising, in combination:

a sheet-feeding unit, a plurality of printing mechanisms each of which comprises a plate cylinder having a plurality of printing plates mounted thereon for transferring at least two differently colored partial images of a full multicolor print image, a plurality of inking mechanisms which can be cyclically brought into operative engagement with the plate cylinder, and a rubber cylinder and a printing cylinder which together define a printing zone, and a plurality of sheet-guiding cylinders each of which is configured to transport only a single sheet at a time, said sheet-guiding cylinders being arranged between the printing mechanisms, having a diameter corresponding to twice the full multicolor print image length and being operable to turn a sheet from the first side to the second side and wherein alternate printing mechanisms are assigned to print on opposing sides of the sheet.

5. The printing machine according to claim 4 wherein each rubber cylinder has a basic diameter and each printing cylinder has a diameter equal to twice the basic diameter.

6. The printing machine according to claim 4 wherein the rubber cylinder has a basic diameter and the printing cylinder has a diameter equal to an odd-multiple of the basic diameter.

7. The printing machine according to claim 4 wherein the sheet-feeding unit is controllable such that a sheet is not fed into the printing zone when print images are being collected on the rubber cylinder.

8. The printing machine according to claim 4 wherein the sheet-feeding unit is controllable such that a sheet is not fed into the printing image are being transferred from the rubber cylinder to a sheet held on the printing cylinder.

9. The printing machine according to claim 4 wherein the feeding unit includes a feed drum having a diameter corresponding to twice the print image length and a single gripper row.

10. The printing machine according to claim 4 wherein the printing machine is configured for offset printing.

11. The printing machine according to claim 4 wherein the printing machine is configured for indirect intaglio printing.

12. The printing machine according to claim 4 wherein the printing machine is configured for indirect raised printing.

13. A process for printing of multicolor print images on sheets using a printing machine including a sheet-feeding unit, a plurality of printing mechanisms each of which comprises a plate cylinder having a plurality of printing plates mounted thereon for transferring at least two differently colored partial images of a full multicolor print image, a plurality of inking mechanisms which can be cyclically brought into operative engagement with the plate cylinder, and a rubber cylinder and a printing cylinder which together define a printing zone, and a plurality of sheet-guiding cylinders each of which is configured to transport only a single sheet at a time, said sheet-guiding cylinders being arranged between the printing mechanisms, having a diameter corresponding to twice the full multicolor print image length and being operable to turn a sheet from the first side to the second side and wherein alternate printing mechanisms are assigned to print on opposing sides of the sheet, the printing process comprising the steps of:

applying two partial images of a two-color print image for the first side of the sheet onto the rubber cylinder of a first printing mechanism, feeding a first printing sheet from the sheet feeding unit to the printing cylinder of the first printing mechanism such that both partial images are transferred from the rubber cylinder to the first sheet in register one on the other, and feeding a second sheet from the sheet feeding unit to the printing cylinder only when the two partial images have again been collected on the rubber cylinder, turning the first sheet from its first to its second side as it is transported from the first printing mechanism to a second printing mechanism, applying a print image of at least two colors collected on the rubber cylinder of the second printing mechanism onto the second side of the first sheet.

14.The printing process according to claim 13 wherein each rubber cylinder has a diameter corresponding to a single print image length and sheets are fed to each printing zone on every other revolution of the rubber cylinder.

15.The printing process according to claim 13 wherein each printing cylinder has a multiple number of working surfaces and the sheets are fed to each printing zone in every other working surface.

* * * * *